US007347388B2

(12) United States Patent
Chung

(10) Patent No.: US 7,347,388 B2
(45) Date of Patent: Mar. 25, 2008

(54) SHOWER HEAD

(75) Inventor: Chin-Tang Chung, Changhua Hsien (TW)

(73) Assignees: Shong I Copper Ltd., Changhua Hsien (TW); National Craft Industries Inc., Taipei Hsien (TW)

( * ) Notice: Subject to any disclaimer, the term of this patent is extended or adjusted under 35 U.S.C. 154(b) by 380 days.

(21) Appl. No.: 11/158,125

(22) Filed: Jun. 21, 2005

(65) Prior Publication Data

US 2006/0283986 A1 Dec. 21, 2006

(51) Int. Cl.
*B05B 1/18* (2006.01)
*B05B 1/14* (2006.01)
*B05B 1/00* (2006.01)

(52) U.S. Cl. ..... 239/567; 239/558; 239/559; 239/596

(58) Field of Classification Search ..... 239/567, 239/548, 558, 559, 596, 456, 536–541, 553.3, 239/556, 557, 587.1, 587.3, 587.4, 600
See application file for complete search history.

(56) References Cited

U.S. PATENT DOCUMENTS

| | | | | |
|---|---|---|---|---|
| 2,056,103 | A * | 9/1936 | Herzbrun et al. | 239/451 |
| 2,779,625 | A * | 1/1957 | Filliung | 239/111 |
| 2,874,001 | A * | 2/1959 | Webb | 239/533.14 |
| 6,241,166 | B1 | 6/2001 | Overington et al. | 239/553.3 |
| 6,739,527 | B1 * | 5/2004 | Chung | 239/558 |
| 2002/0158154 | A1 * | 10/2002 | Lee | 239/548 |

* cited by examiner

*Primary Examiner*—Darren Gorman
(74) *Attorney, Agent, or Firm*—Alan Kamrath; Kamrath & Associates, PA

(57) ABSTRACT

A shower head includes a main body, a mounting seat, a locking nut, a connecting disk, an O-ring, a gasket, a water outlet faceplate, an adjusting bolt, and a connector unit. Thus, the connecting disk is moved toward the main body by rotation of the adjusting bolt so that the O-ring is moved upward with the connecting disk and closely urged on the inner wall of the main body, thereby forming a closely sealing effect between the connecting disk and the inner wall of the main body.

19 Claims, 4 Drawing Sheets

SHOWER HEAD

BACKGROUND OF THE INVENTION

1. Field of the Invention

The present invention relates to a shower head, and more particularly to a shower head having a closely sealing effect.

2. Description of the Related Art

A conventional shower head in accordance with the prior art is disclosed in U.S. Pat. No. 6,241,166. However, the conventional shower head has a complicated construction, thereby increasing costs of fabrication and assembly. In addition, when the bolt 38 is rotated to pull the bush 42 and the upper wall 8 upward to press the sealing ring 16, the upper wall 8 is easily deformed to reduce its diameter, thereby forming a clearance between the upper wall 8 and the spray plate 10 so that the shower head easily produces leak. Further, the spray plate 10 is integrally formed with the upper wall 8 so that the spray plate 10 cannot be removed from the upper wall 8, thereby causing inconvenience to a user when cleaning the water outlet holes of the spray plate 10. Further, the conventional shower head is not operated smoothly and does not have a constant water flow rate.

SUMMARY OF THE INVENTION

In accordance with the present invention, there is provided a shower head, comprising shower head, comprising a main body having a closed upper portion and an open lower portion, a connecting disk mounted in the lower portion of the main body, an O-ring mounted between the connecting disk and an inner wall of the main body, and a water outlet faceplate mounted on and combined with the connecting disk integrally.

The primary objective of the present invention is to provide a shower head, wherein the connecting disk is moved toward the main body by rotation of the adjusting bolt so that the O-ring is moved upward with the connecting disk and closely urged on the inner wall of the main body, thereby forming a closely sealing effect between the connecting disk and the inner wall of the main body.

Another objective of the present invention is to provide a shower head, wherein the gasket is enclosed around the locking flange of the disk body of the connecting disk and the clamping portion of the water outlet faceplate is pressed on the gasket so that the water outlet faceplate and the connecting disk are combined integrally.

A further objective of the present invention is to provide a shower head, wherein the user only needs to rotate the adjusting bolt to move the connecting disk and the water outlet faceplate toward the main body, thereby facilitating the user adjusting the tension between the water outlet faceplate and the main body.

A further objective of the present invention is to provide a shower head, wherein the connecting disk and the water outlet faceplate are removed from the main body by unscrewing the adjusting bolt, thereby facilitating the user cleaning the water outlet holes of the water outlet faceplate.

A further objective of the present invention is to provide a shower head, wherein the water is directly injected outward from the water outlet holes of the water outlet faceplate for use with a user, so that the shower head is operated smoothly and has a constant water flow rate.

A further objective of the present invention is to provide a shower head, wherein the connecting disk is integrally formed with the locking sleeve, thereby decreasing costs of fabrication, and thereby simplifying the process of assembly.

Further benefits and advantages of the present invention will become apparent after a careful reading of the detailed description with appropriate reference to the accompanying drawings.

DETAILED DESCRIPTION OF THE INVENTION

Figure 1:
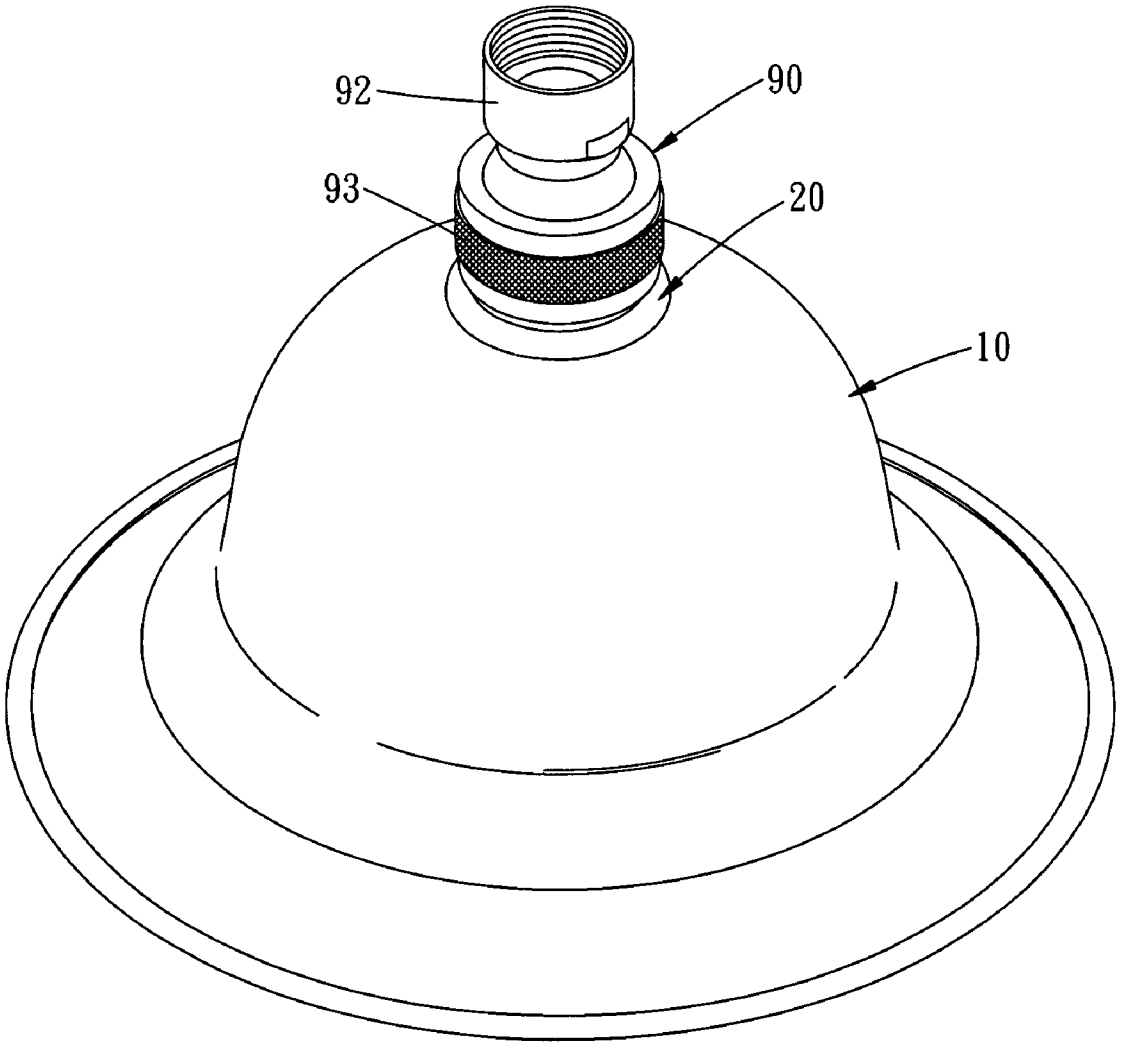
FIG. 1 is a perspective view of a shower head in accordance with the preferred embodiment of the present invention.
Figure 2:
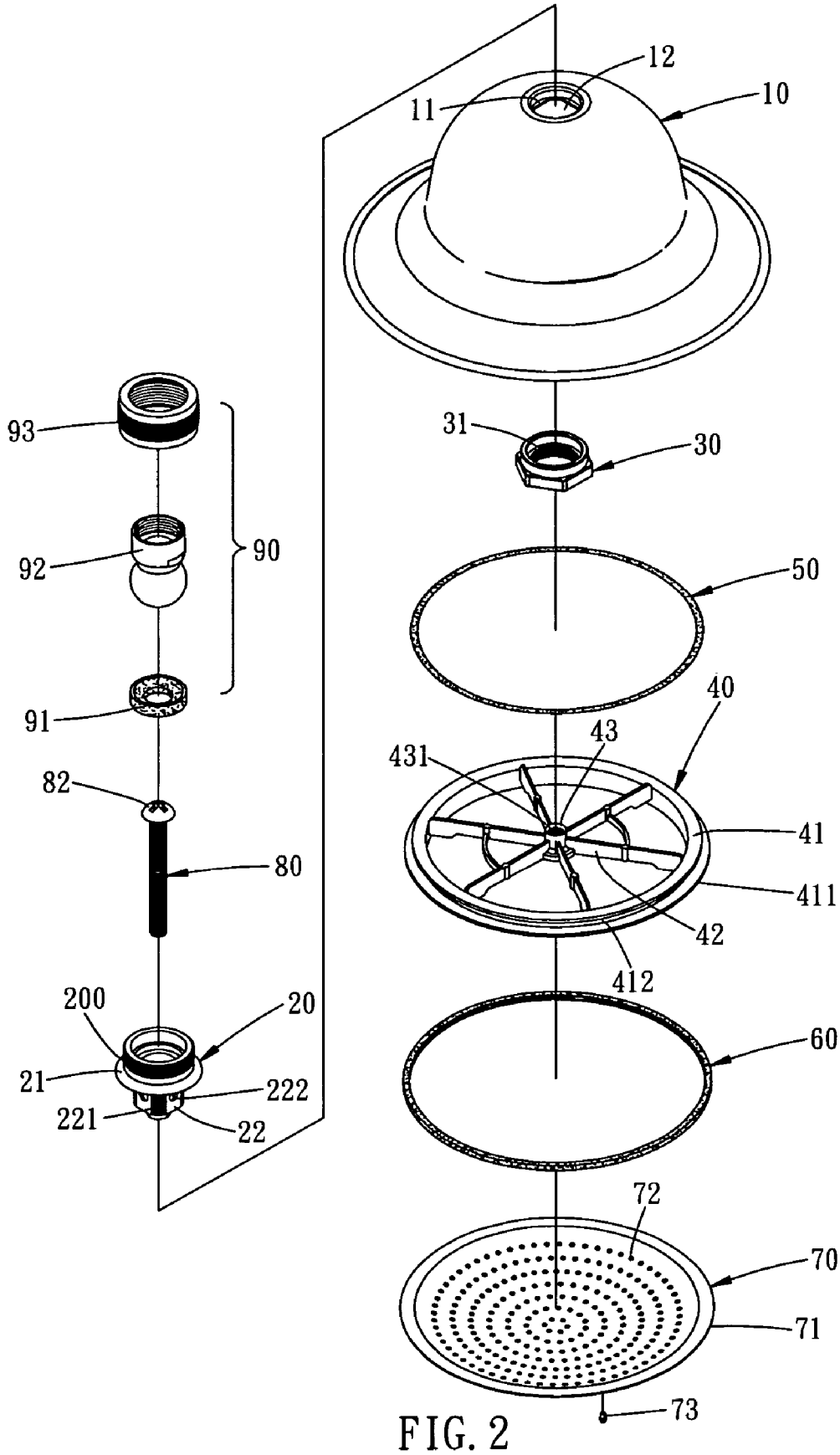
FIG. 2 is an exploded perspective view of the shower head as shown in FIG. 1.
Figure 4:
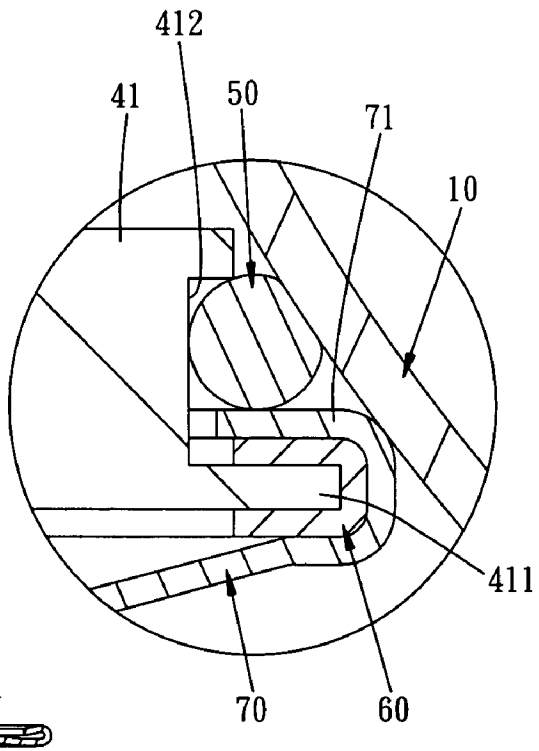
FIG. 4 is a locally enlarged view of the shower head as shown in FIG. 3.
Figure 3:
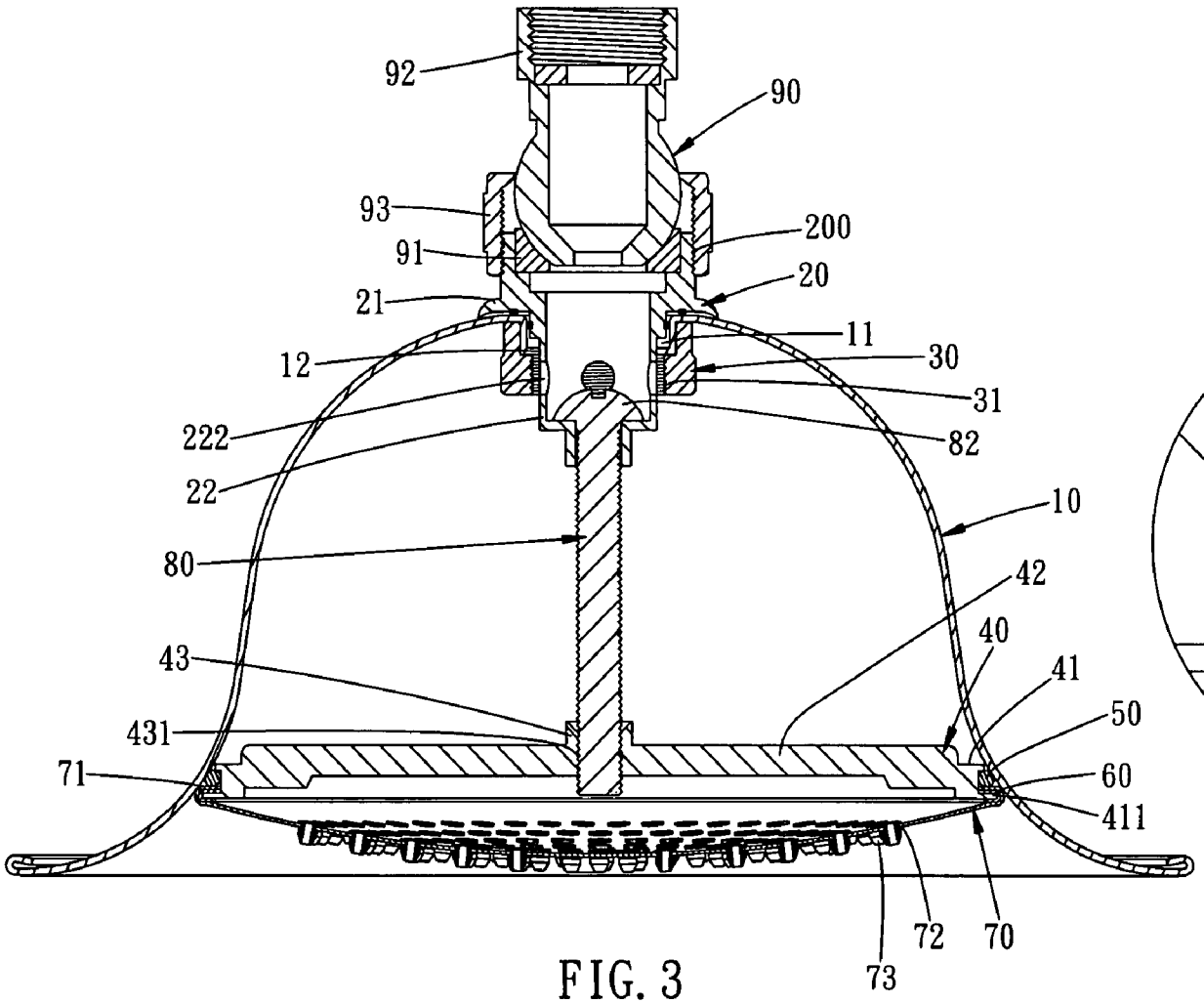
FIG. 3 is a plan cross-sectional view of the shower head as shown in FIG. 1.

Referring to the drawings and initially to FIGS. 1-4, a shower head in accordance with the preferred embodiment of the present invention comprises a main body 10, a mounting seat 20, a locking nut 30, a connecting disk 40, an O-ring 50, a gasket 60, a water outlet faceplate 70, an adjusting bolt 80, and a connector unit 90.

The main body 10 has a bell shape and has a closed upper portion and an open lower portion. The upper portion of the main body 10 is formed with a circular recess 11 having a bottom face formed with a substantially square chamfered positioning hole 12.

The mounting seat 20 is secured on the upper portion of the main body 10 and has an upper portion protruding outward from the main body 10, a lower end formed with a substantially square chamfered mounting portion 22 secured in the positioning hole 12 of the main body 10 and a mediate portion formed with an outward extended substantially arc-shaped resting flange 21 rested on the upper portion of the main body 10. The upper portion of the mounting seat 20 is formed with an outer thread 200, and the mounting portion 22 of the mounting seat 20 is formed with an outer thread 221. The mounting portion 22 of the mounting seat 20 has a flattened face formed with at least one water inlet hole 222 communicating with an inside of the mounting seat 20 and an inside of the main body 10.

The locking nut 30 is secured on the mounting portion 22 of the mounting seat 20 and rested on the upper portion of the main body 10 to secure the mounting seat 20 on the upper portion of the main body 10. The locking nut 30 is located in the main body 10 and formed with an inner thread 31 screwed onto the outer thread 221 of the mounting portion 22 of the mounting seat 20.

The connecting disk 40 is mounted in the lower portion of the main body 10 and includes an annular disk body 41 rested on an inner wall of the main body 10, a threaded locking sleeve 43 located at a central portion of the disk body 41, and a plurality of radially arranged connecting ribs 42 mounted between the disk body 41 and the locking sleeve 43. The disk body 41 of the connecting disk 40 has a periphery formed with a radially and outwardly extended locking flange 411 and an annular groove 412 located above the locking flange 411. The locking sleeve 43 of the connecting disk 40 is formed with an inner thread 431.

The O-ring 50 is mounted between the disk body 41 of the connecting disk 40 and the inner wall of the main body 10 and located in the annular groove 412 of the disk body 41 of the connecting disk 40. The O-ring 50 has a substantially circular cross-sectional profile.

The gasket 60 is mounted on the periphery of the disk body 41 of the connecting disk 40 and enclosed around the locking flange 411 of the disk body 41 of the connecting disk 40. The gasket 60 has a substantially U-shaped cross-sectional profile having an opening directed toward the locking flange 411 of the disk body 41 of the connecting disk 40.

The water outlet faceplate 70 is mounted on a bottom of the disk body 41 of the connecting disk 40 and has a periphery formed with a substantially L-shaped clamping portion 71 pressed on the gasket 60 so that the water outlet faceplate 70 and the connecting disk 40 are combined integrally. The water outlet faceplate 70 has a substantially convex cross-sectional profile and has a surface formed with a plurality of water outlet holes 72 each communicating with the inside of the main body 10 and each provided with a nozzle 73.

The adjusting bolt 80 is rotatably mounted in the mounting seat 20 and has a distal end extended through the mounting portion 22 of the mounting seat 20 and screwed into the inner thread 431 of the locking sleeve 43 of the connecting disk 40. The adjusting bolt 80 has a bolt head 82 rotatably mounted in the mounting portion 22 of the mounting seat 20 and rested on a stepped bottom of the mounting portion 22 of the mounting seat 20.

The connector unit 90 is detachably mounted on the upper portion of the mounting seat 20 and includes a universal connector 92 rotatably mounted in the upper portion of the mounting seat 20, a gasket 91 mounted between the universal connector 92 and the upper portion of the mounting seat 20, and an urging nut 93 screwed onto the outer thread 200 of the upper portion of the mounting seat 20 and urged on the universal connector 92.

In assembly, the distal end of the adjusting bolt 80 is screwed into the inner thread 431 of the locking sleeve 43 of the connecting disk 40 so that when the adjusting bolt 80 is rotated relative to the locking sleeve 43 of the connecting disk 40, the locking sleeve 43 of the connecting disk 40 is moved axially toward the main body 10 by rotation of the adjusting bolt 80. Thus, the O-ring 50 is moved upward with the disk body 41 of the connecting disk 40 and closely urged on the inner wall of the main body 10, thereby forming a closely sealing effect between the disk body 41 of the connecting disk 40 and the inner wall of the main body 10.

Figure 5:
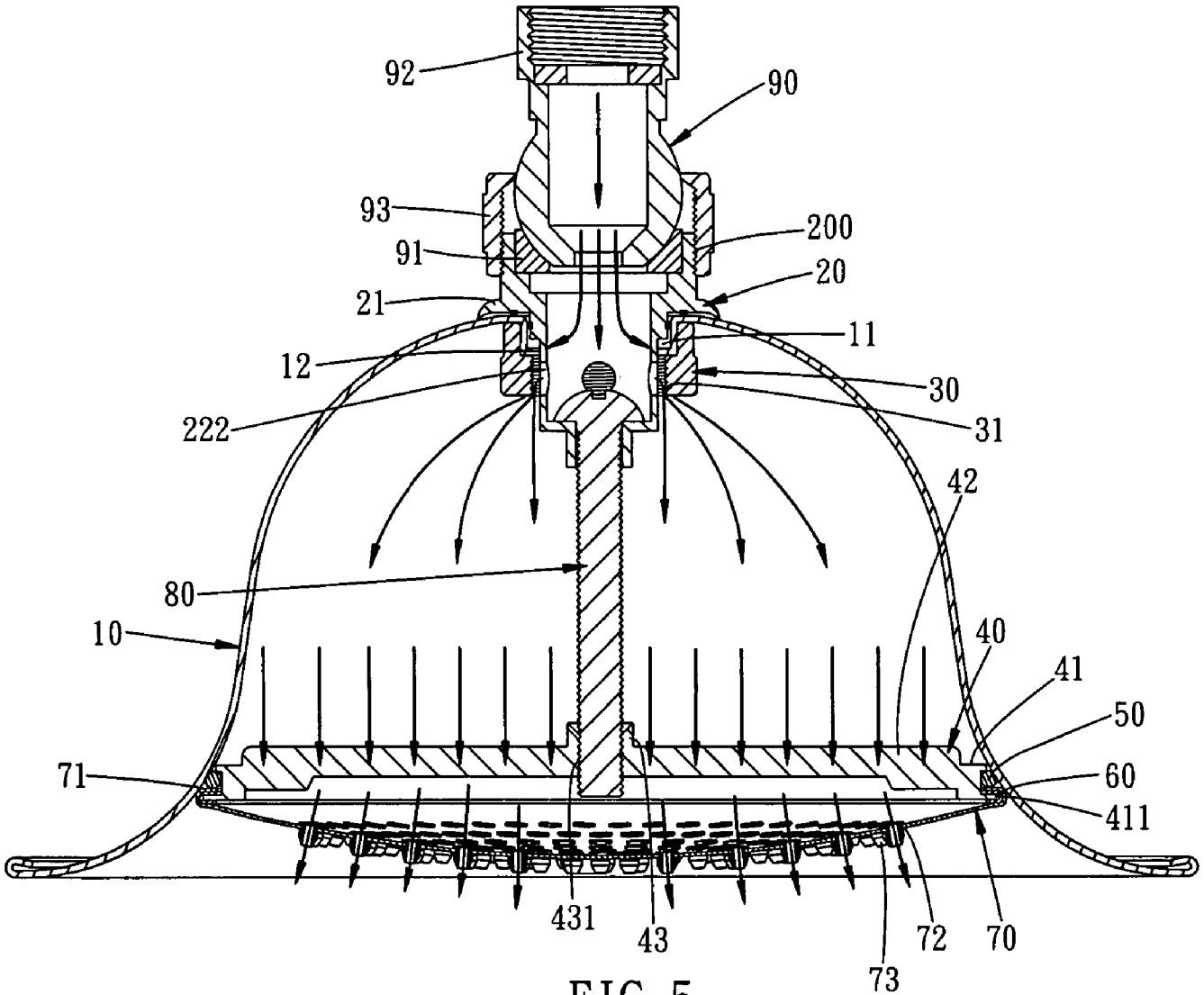
FIG. 5 is a schematic operational view of the shower head as shown in FIG. 4.

When in use, referring to FIG. 5, the universal connector 92 of the connector unit 90 is connected to a wall pipe to introduce the water from the wall pipe into the mounting seat 20. Then, the water flows through the water inlet hole 222 of the mounting seat 20 into the inside of the main body 10, then passes through the connecting ribs 42 of the connecting disk 40 and is finally injected outward from the water outlet holes 72 of the water outlet faceplate 70 for use with a user.

Accordingly, the connecting disk is moved toward the main body by rotation of the adjusting bolt so that the O-ring is moved upward with the connecting disk and closely urged on the inner wall of the main body, thereby forming a closely sealing effect between the connecting disk and the inner wall of the main body. In addition, the gasket is enclosed around the locking flange of the disk body of the connecting disk and the clamping portion of the water outlet faceplate is pressed on the gasket so that the water outlet faceplate and the connecting disk are combined integrally. Further, the user only needs to rotate the adjusting bolt to move the connecting disk and the water outlet faceplate toward the main body, thereby facilitating the user adjusting the tension between the water outlet faceplate and the main body. Further, the connecting disk and the water outlet faceplate are removed from the main body by unscrewing the adjusting bolt, thereby facilitating the user cleaning the water outlet holes of the water outlet faceplate. Further, the water is directly injected outward from the water outlet holes of the water outlet faceplate for use with a user, so that the shower head is operated smoothly and has a constant water flow rate. Further, the connecting disk is integrally formed with the locking sleeve, thereby decreasing costs of fabrication, and thereby simplifying the process of assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A shower head, comprising:

a main body having a closed upper portion and an open lower portion;

a connecting disk mounted in the lower portion of the main body;

an O-ring mounted between the connecting disk and an inner wall of the main body;

a water outlet faceplate mounted on and combined with the connecting disk integrally;

wherein the connecting disk includes an annular disk body rested on the inner wall of the main body and having a periphery formed with a radially and outwardly extended locking flange and an annular groove located above the locking flange.

2. The shower head in accordance with claim 1, wherein the connecting disk further includes a locking sleeve located at a central portion of the disk body and formed with an inner thread.

3. The shower head in accordance with claim 2, wherein the connecting disk further includes a plurality of radially arranged connecting ribs mounted between the disk body and the locking sleeve.

4. The shower head in accordance with claim 1, wherein the O-ring is mounted between the disk body of the connecting disk and the inner wall of the main body and located in the annular groove of the disk body of the connecting disk.

5. The shower head in accordance with claim 1, wherein the O-ring has a substantially circular cross-sectional profile.

6. The shower head in accordance with claim 1, further comprising a gasket mounted on the periphery of the disk body of the connecting disk and enclosed around the locking flange of the disk body of the connecting disk.

7. The shower head in accordance with claim 6, wherein the gasket has a substantially U-shaped cross-sectional profile having an opening directed toward the locking flange of the disk body of the connecting disk.

8. The shower head in accordance with claim 6, wherein the water outlet faceplate is mounted on a bottom of the disk body of the connecting disk and has a periphery formed with a clamping portion pressed on the gasket so that the water outlet faceplate and the connecting disk are combined integrally.

9. The shower head in accordance with claim 8, wherein the clamping portion of the water outlet faceplate is substantially L-shaped.

10. The shower head in accordance with claim 1, wherein the water outlet faceplate has a substantially convex cross-sectional profile.

11. The shower head in accordance with claim 1, wherein the water outlet faceplate has a surface formed with a plurality of water outlet holes each communicating with the inside of the main body and each provided with a nozzle.

12. The shower head in accordance with claim 2, further comprising:

a mounting seat secured on the upper portion of the main body and having an upper portion protruding outward from the main body and a lower end formed with a mounting portion;

a locking nut secured on the mounting portion of the mounting seat and rested on the upper portion of the main body to secure the mounting seat on the upper portion of the main body;

an adjusting bolt rotatably mounted in the mounting seat and having a distal end extended through the mounting portion of the mounting seat and screwed into the inner thread of the locking sleeve of the connecting disk.

13. The shower head in accordance with claim 12, wherein:

the upper portion of the main body is formed with a circular recess having a bottom face formed with a substantially square chamfered positioning hole;

the mounting portion of the mounting seat is secured in the positioning hole of the main body and formed with an outer thread;

the locking nut is located in the main body and formed with an inner thread screwed onto the outer thread of the mounting portion of the mounting seat;

the adjusting bolt has a bolt head rotatably mounted in the mounting portion of the mounting seat and rested on a stepped bottom of the mounting portion of the mounting seat.

14. The shower head in accordance with claim 12, wherein the mounting seat has a mediate portion formed with an outward extended substantially arc-shaped resting flange rested on the upper portion of the main body.

15. The shower head in accordance with claim 12, wherein the connecting disk is moved toward the main body by rotation of the adjusting bolt so that the O-ring is moved upward with the connecting disk and urged on the inner wall of the main body, thereby forming a closely sealing effect between the connecting disk and the inner wall of the main body.

16. The shower head in accordance with claim 2, wherein the connecting disk is integrally formed with the locking sleeve.

17. The shower head in accordance with claim 1, wherein the main body has a bell shape.

18. The shower head in accordance with claim 12, wherein the mounting portion of the mounting seat has a substantially square chamfered shape.

19. The shower head in accordance with claim 12, wherein the mounting portion of the mounting seat has a flattened face formed with at least one water inlet hole communicating with an inside of the mounting seat and an inside of the main body.

* * * * *